US007207638B2

(12) United States Patent
Duke

(10) Patent No.: US 7,207,638 B2
(45) Date of Patent: Apr. 24, 2007

(54) VARYING CUE DELAY CIRCUIT

(75) Inventor: Ronald J. Duke, Centerville, OH (US)

(73) Assignee: Eastman Kodak Company, Rochester, NY (US)

( * ) Notice: Subject to any disclaimer, the term of this patent is extended or adjusted under 35 U.S.C. 154(b) by 392 days.

(21) Appl. No.: 10/948,071

(22) Filed: Sep. 23, 2004

(65) Prior Publication Data

US 2006/0061606 A1 Mar. 23, 2006

(51) Int. Cl.
*B41J 29/38* (2006.01)
*B41J 2/00* (2006.01)

(52) U.S. Cl. ..... 347/5; 347/9; 347/148; 368/10

(58) Field of Classification Search ..... 347/5, 347/148
See application file for complete search history.

(56) References Cited

U.S. PATENT DOCUMENTS 6,241,334 B1 * 6/2001 Haselby ..... 347/19
6,912,179 B1 * 6/2005 Duke ..... 368/10
2004/0183842 A1 * 9/2004 Kobayashi et al. ..... 347/10

* cited by examiner

*Primary Examiner*—Manish Shah
*Assistant Examiner*—Shelby Fidler
(74) *Attorney, Agent, or Firm*—The Buskop Law Group, P.C.

(57) ABSTRACT

An integrated circuit for an ink jet printer includes a state machine with numerous sequenced logic circuits to generate buffered control signals from the tachometer input. A counter counts one of the buffered control signals from the state machine forming a write address. A synchronous up-down counter receives a cue delay value when the up-down counter receives a buffered control signal thereby forming a delayed count. An adder receives the write address and the delayed count and generates a read address. A comparator compares the delayed count to the cue delay value and sets a comparator output depending upon whether the delayed count is greater than or less than the cue delay value. A multiplexer receives the read and write addresses and the buffered control signals and sends a single to RAM. A logic circuit receives the buffered control signals and outputs a delayed cue signal to the printing system.

12 Claims, 1 Drawing Sheet

VARYING CUE DELAY CIRCUIT

CROSS REFERENCE TO RELATED APPLICATIONS

1. Field of the Invention

The present embodiments relate to an integrated circuit for varying cue delays to be used in conjunction with inkjet printing.

2. Background of the Invention

Current art tach and cue systems use Random Access Memory (RAM) to write cue values on each tach interval and read those values back to some offset or delayed address. The offset or delayed address is incremented with each tach. The delay time is changed by loading new delay values through a series of small incremental changes. Typically, the incremental changes are around forty counts as a maximum. When a specific tach count is greater than the set incremental change, new delay values are loaded. Alternatively, new delay values are loaded through immediate loads when cues are not used. Current art software writes a value and, then, the hardware synchronizes the loading of the new delay value at a specific tach count greater than the set incremental change after the next cue.

The described current art methods are cumbersome to use and results in long time lapses to become effective. The current art method misses or repeats values that occur within the difference of the new cue delay value and the old cue delay value. The current art method typically only works if the cues are assumed to not occur too close together and the modified values are not too far apart.

A need exists for a cue delay circuit that enables all values (large and small) to be entered at any time and initiates the new delay immediately, not based upon the next cue.

A need exists for a cue delay circuit that does not skip over cues, repeat cues, and does not requires an assumption to be made about cue spacing.

The present embodiments described herein were designed to meet these needs.

SUMMARY OF THE INVENTION

An integrated circuit for an ink jet printer allows cue signal delays to be changed immediately without waiting for the next cue. The integrated circuit utilizes RAM that enables both small and large values to be entered. The integrated circuit ensures a cue is not skipped, ensures a cue is not repeated, and does not require any assumptions to be made about cue spacing.

The embodied integrated circuit utilizes a state machine, a counter, a synchronous loadable up-down counter, an adder, a comparator, a multiplexer (MUX), random-access memory (RAM), and a logic circuit.

The state machine has numerous sequenced logic circuits and generates one or more buffered control signals from the tachometer input. The counter counts the buffered control signals from the state machine and creates a write address. The synchronous loadable up-down counter receives a cue delay value and loads the cue delay value into the synchronous loadable up-down counter. The synchronous loadable up-down counter receives a cue delay value when the synchronous loadable up-down counter receives one of the buffered control signals, thereby forming a delayed count. The adder receives the write address and the delayed count and, then, generates a read address.

The comparator in the embodied integrated circuit compares the delayed count to the cue delay value. The comparator sets a comparator output at a logic high value depending upon whether the delayed count is greater than or less than the cue delay value. The multiplexer (MUX) receives the read address, the write address, and one of the buffered control signals, and, then, forms a multiplexer output that is sent to RAM. The logic circuit receives one of the buffered control signals and outputs a delayed cue signal to the printing system.

A key benefit of the present integrated circuits and methods is that the ink jet printer does not lose cues when the cue delay is varied. The cue delay incorporated in the embodiments herein can be varied at any time designated by the user and does not require a delay to prevent overwriting a cue.

BRIEF DESCRIPTION OF THE DRAWINGS

In the detailed description of the preferred embodiments presented below, reference is made to the accompanying drawings, in which.

Figure 1:
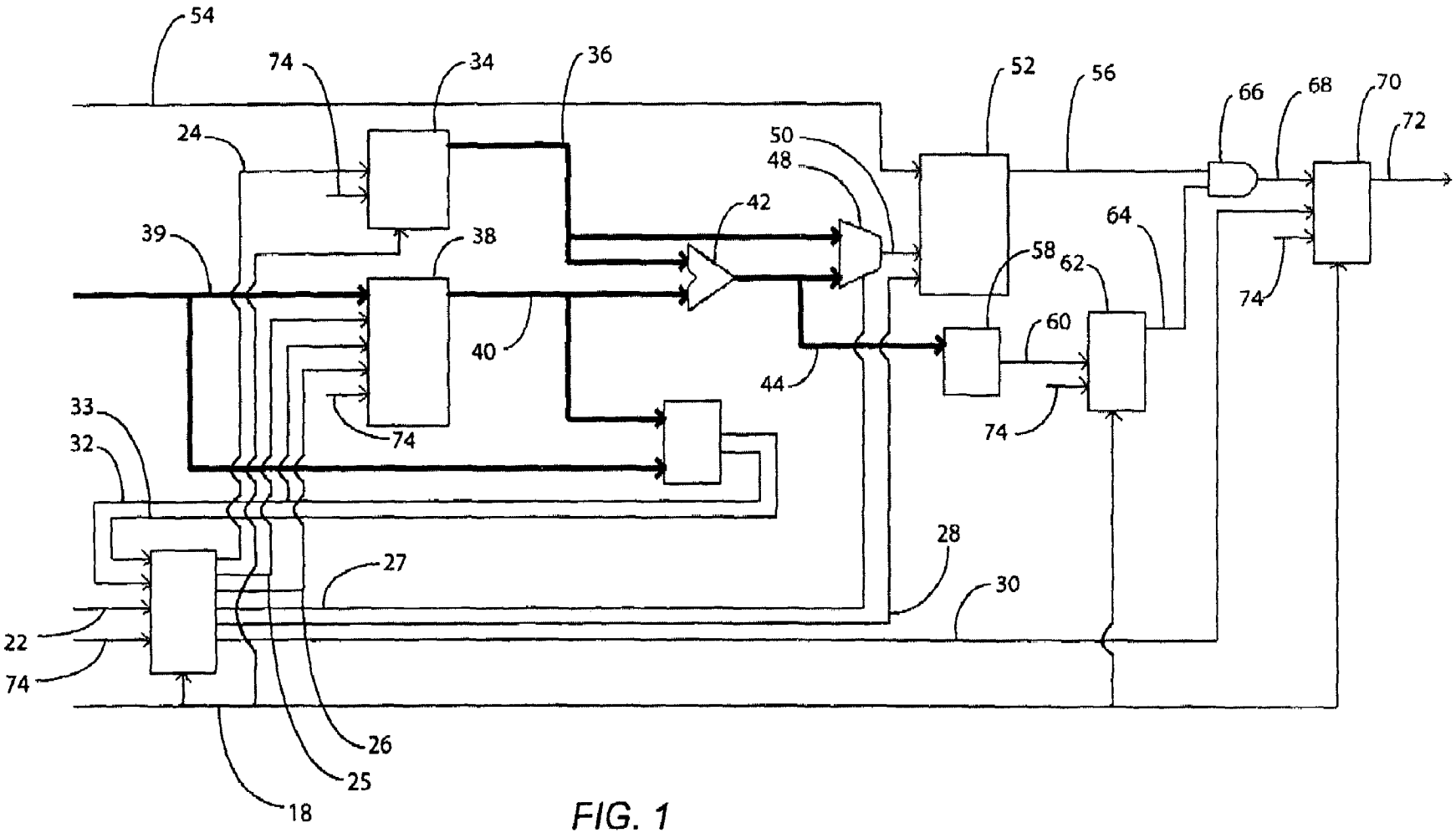
FIG. 1 depicts a schematic of an embodiment of the integrated circuit for varying cue delays.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

The cue delay in the embodiments herein can be adjusted when the user is speeding up or slowing down the press. The cue delay can be adjusted to provide for automatic time of flight correction to ensure that images from multiple printheads remain aligned as the print speed varies. For time of flight and typical operator shifts, the embodied circuits and methods permit shifts from one document to another document with a higher print quality at faster speed than known circuitry.

The present integrated circuits and methods allow the magnitude of change to be varied based on the need of the user and to facilitate the alignment of a printhead. The present integrated circuits can be reprogrammed to change cue delay signals using RAM. The use of RAM enables both large and small values to be entered at any time and causes the new delay to occur immediately and not on the next cue.

The embodiments herein can be used to can be used to establish a delay increase instantly. The delay decrease can be initiated immediately by reading through random access memory (RAM). Further, each delay can start independently of other variables.

The cue delay in the embodiments herein reduces the chance of repeating cues or the chance of skipping over cues during printing. The cue delay relates to cue spacing as well. The embodied circuits and methods do not require the traditional need for assumptions concerning the actual cue spacing or the estimated cue spacing. More specifically, the prior art restrictions require a minimum document length for the user; for the circuit embodied herein, the minimum document length is not a constraint.

The embodied cue delay is useful in a system that is used to check prints, such as a page correlation system based on cues.

With reference to the figures, FIG. 1 depicts an integrated circuit for an ink jet printer, such as a printer from Kodak Versamark of Dayton, Ohio. An embodied integrated circuit contains a state machine 20, which is a series of shift registers. The state machine 20 includes numerous sequenced logic circuits adapted to receive a start pulse 18. The start pulse 18 initializes the state machine. The state machine 20 receives a tachometer input 22, wherein the tachometer is used to indicate the movement of printable media in the printer, a first comparator output 32, and a second comparator output 33. The tachometer generates numerous buffered control signals 24, 25, 26, 27 28, and 30 from the tachometer input 22. The electrical logic components that are connected to form the varying cue delay circuit, with the exception of an oscillator 74 and RAM 52, can all be found on a FPGA model XC4062XLA-HQ304, available from Xilinx, of San Jose, Calif.

The circuits include a counter 34 with numerous sequenced logic circuits to count one of the buffered control signals 24 from the state machine 20 before forming a write address 36 with twenty address bits numbered 0 through 19.

A synchronous loadable up-down counter 38 in the integrated circuits is used to receive a cue delay value 39. The cue delay value 39 is loaded into the synchronous loadable up-down counter 38 when the synchronous loadable up-down counter 38 receives one of the buffered control signals 25 from the state machine 20. When the synchronous loadable up-down counter 38 receives the buffered control signal 26, the synchronous loadable up-down counter 38 forms a delayed count 40.

Continuing with FIG. 1, an adder 42 receives the write address 36 and the delayed count 40. The adder 42 generates a read address 44 using a subtractor function of the write address minus the delayed count.

A comparator 46 compares the delayed count 40 to the cue delay value 39. If the delayed count 40 is greater than the cue delay value 39, the comparator 46 sets a first comparator output 32 at a logic high value. If the delayed count 40 is less than the cue delay value 39, the comparator 46 sets a second comparator output 33 at the logic high value.

A multiplexer (MUX) 48 receives the read address 44, the write address 36, and one of the buffered control signals 27 and, then forms a multiplexer output 50 based upon the inputs. A random-access memory (RAM) 52 receives the multiplexer output 50. An example of a RAM that can be used in the circuit is a model CY7C1007-15VC available from Cypress Semiconductor, of San Jose, Calif. The multiplexer output 50 serves as a RAM address. One of the buffered control signals 28 serves as a write/read control for the RAM, and the cue signal 54 provides the data stored in the RAM, resulting in the RAM output signal 56.

In an alternative embodiment, the embodied integrated circuits can include a second comparator 58 that compares the read address 44 to a zero value. If the read address 44 is greater than zero, the second comparator 58 sets a third comparator output 60 at the logic high value.

The embodied integrated circuits can include a flip flop 62 that latches to the second comparator 58 output forming a latched comparator output 64. An example of a flip flop 62 is a synchronous D flip flop with a chip enabler and a reset.

In an alternative embodiment, the embodied integrated circuits can include a cue pulse conditioning circuit. The cue pulse conditioning circuit modifies the cue signal 54 by latching the cue signal 54 and synchronizing the transmission of the cue signal 54 with a buffered control signal. The cue pulse conditioning circuit can further include numerous gates and flip flops.

The embodied integrated circuits can include a gate circuit 66. The gate circuit 66 receives the latched comparator output 64 and the RAM output signal 56. The gate circuit 66 uses the inputs to form a gated cue signal 68.

Continuing with FIG. 1, the embodied integrated circuits include a logic circuit 70. The logic circuit 70 receives one of the buffered control signals 30 and, optionally, the gated cue signal 68. The logic circuit 70 outputs a delayed cue signal 72 to the printing system.

In an alternative embodiment, the embodied integrated circuits can include an oscillator 74 in communication the state machine 20, the counter 34, the flip flop 62, and the logic circuit 70. An example of a usable oscillator is model EC25M-20.00M available from Ecliptek, of Costa Mesa, Calif.

As an example of the use of the present integrated circuits, a tach pulse causes the control logic to select a write address and writes the "in" cue to the RAM. If the delay comparator indicates the delay count is equal to or greater than the bus delay value, the read address is selected and the RAM contents are output to the "out" cue flip flop. If the delay comparator indicates the delay count is less than the bus delay value, the RAM contents are not read, but the delay count is incremented. A delay increase is, therefore, instantly implemented since no other RAM contents are read until the delay count is equal to the bus delay value.

If a circuit does not have a tach pulse to service and the delay comparator indicates the delay count is greater than the bus delay value, the read address is selected and the RAM contents are output to the "out" cue flip flop. The delay counter is decremented with each read until the delay count is equal to the bus delay value. A delay decrease is, therefore, instantly initiated by reading the RAM contents up to the currently requested delay value.

In all cases, the RAM contents are read, thereby providing numerous benefits. Since all contents are read, a cue is never skipped. Since all contents are read only once, a cue is never repeated. The cues are never skipped or repeated regardless of the number of times the requested delay is modified, regardless whether the cue spacing is small or large, regardless of the magnitude of the requested delay, and regardless of when the delay is modified.

The embodiments have been described in detail with particular reference to certain preferred embodiments thereof, but it will be understood that variations and modifications can be effected within the scope of the embodiments, especially to those skilled in the art.

Parts List

18. start pulse
20. state machine
22. tachometer input
24. first buffered control signal
25. second buffered control signal
26. third buffered control signal
27. fourth buffered control signal
28. fifth buffered control signal
30. sixth buffered control signal
32. first comparator output
33. second comparator output
34. counter
36. write address
38. synchronous loadable up-down counter
39. cue delay value
40. delayed count
42. adder
44. read address
46. first comparator

48. multiplexer
50. multiplexer output
52. random access memory (RAM)
54. cue signal
56. RAM output signal
58. second comparator
60. third comparator output
62. flip flop
64. latched comparator output
66. gate circuit
68. gated cue signal
70. logic circuit
72. delayed cue signal
74. oscillator

The invention claimed is:

1. An integrated circuit for an ink jet printer comprising:

a. a state machine (20) comprising a plurality of sequenced logic circuits, wherein the state machine (20) receives a tachometer (22) input, a first comparator output (32), and a second comparator output (33), and wherein the state machine (20) generates a plurality of buffered control signals (24, 25, 26, 27, 28, 30) from the tachometer input (22);

b. a counter (34) comprising a plurality of sequenced logic circuits to count one of the buffered control signals from the state machine forming a write address (36);

c. a synchronous loadable up-down counter (38) adapted to receive a cue delay value (39), wherein the cue delay value is loaded into the synchronous loadable up-down counter (38) when the synchronous loadable up-down counter receives one of the buffered control signals forming a delayed count (40);

d. an adder (42) adapted to receive the write address (36) and the delayed count (40), wherein the adder (42) generates a read address (44);

e. a comparator (46) adapted to compare the delayed count (40) to the cue delay value (39), wherein the comparator (46) sets the first comparator output at a logic high value when the delayed count (40) is greater than the cue delay value (39), and wherein the comparator sets the second comparator output at the logic high value when the delayed count (40) is less than the cue delay value (39);

f. a multiplexer (mux) (48) adapted to receive the read address (44), the write address (36), and one of the buffered control signals, wherein the mux forms a multiplexer output (50);

g. a random access memory (ram) (52) adapted to receive the multiplexer output (50); and h. a logic circuit (70) adapted to receive one of the buffered control signals, wherein the logic circuit outputs a delayed cue signal (72) to the printing system.

2. The integrated circuit of claim 1, further comprising an oscillator in communication with the state machine, the counter, and the logic circuit.

3. The integrated circuit of claim 1, further comprising a second comparator adapted to compare the read address to zero, wherein the second comparator sets a third comparator output at the logic high value when the read address is greater than zero.

4. The integrated circuit of claim 1, further comprising a flip flop adapted to latch to the second comparator output forming a latched comparator output.

5. The integrated circuit of claim 4, wherein the flip flop is a synchronous d flip flop comprising a chip enabler and a reset.

6. The integrated circuit of claim 4, further comprising a gate circuit adapted to receive the latched comparator output and a ram output signal forming a gated cue signal.

7. The integrated circuit of claim 6, wherein the logic circuit receives the gated cue signal.

8. The integrated circuit of claim 1, further comprising a cue pulse conditioning circuit, wherein the cue pulse conditioning circuit is adapted to modify the cue signal by latching the cue signal and synchronizing the transmission of the cue signal with a buffered control signal.

9. The integrated circuit of claim 8, wherein the cue pulse conditioning circuit further comprises a plurality of gates and flip flops.

10. The integrated circuit of claim 1, wherein the state machine is adapted to receive a start pulse, wherein the start pulse initializes the state machine.

11. The integrated circuit of claim 1, wherein the multiplexer output serves as a ram address, wherein a cue signal and one of the buffered control signals serves as a write/read control for the ram to provide a ram output signal.

12. The integrated circuit of claim 1, wherein the adder adapted generates a read address using a subtractor function of the write address.

* * * * *